US006454606B2

(12) United States Patent
Igarashi

(10) Patent No.: US 6,454,606 B2
(45) Date of Patent: Sep. 24, 2002

(54) CABLE CONNECTOR HAVING A HOLDING PORTION FOR HOLDING A CABLE

(75) Inventor: Isao Igarashi, Akishima (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 09/837,709

(22) Filed: Apr. 18, 2001

(30) Foreign Application Priority Data

Apr. 26, 2000 (JP) ..... 2000-125548

(51) Int. Cl.[7] ..... H01R 9/03
(52) U.S. Cl. ..... 439/610
(58) Field of Search ..... 439/98, 77, 497, 439/498, 499, 422, 610

(56) References Cited

U.S. PATENT DOCUMENTS 4,451,099 A * 5/1984 Bricker, Jr. et al. ..... 439/100
4,875,877 A * 10/1989 Fleak et al. ..... 439/497
5,718,607 A * 2/1998 Murphy et al. ..... 439/610
5,725,387 A * 3/1998 O'Sullivan et al. ..... 439/98

* cited by examiner

*Primary Examiner*—Tulsidas Patel
(74) *Attorney, Agent, or Firm*—Michael Best & Friedrich LLC; J. Warren Whitesel

(57) ABSTRACT

In a connector for use in connecting a cable (11) such as a coaxial cable, a contact element (12) is held by an insulator (13) and is connected to the cable. A conductive shell (14) covers the insulator. The conductive shell has a holding portion (17) for clamping and holding the cable in cooperation with the insulator. It is preferable that the shell has a first shell component (15) arranged at a position corresponding to a contacting portion of the contact element and fixedly held by the insulator and a second shell component (16) having the holding portion and removably held by the insulator.

10 Claims, 3 Drawing Sheets

CABLE CONNECTOR HAVING A HOLDING PORTION FOR HOLDING A CABLE

BACKGROUND OF THE INVENTION

This invention relates to a connector for use in connecting an object cable such as a coaxial thin wire type cable comprising a plurality of coaxial cables known in the art.

In the object cable of the type, each of the coaxial cables includes a center conductor or a core wire having conductivity, a tubular insulating inner sheath surrounding the core wire, a conductive shield wire surrounding the insulating inner sheath, and an insulating member surrounding the shield wire. The object cable may have a structure such that the coaxial cables are disposed in a flat arrangement with the shield wires partially exposed to form exposed portions. The exposed portions of the shield wires are clamped between a pair of so-called ground bars each of which comprises a metallic plate.

This structure is convenient because the shield wires can collectively be handled via the ground bars. Although each of the coaxial cables is thin, the coaxial cables are collectively kept in the flat arrangement by the ground bars. Thus, this structure is also advantageous in connecting operation to the connector.

However, the coaxial cables have no cladding portion in a specific area which near the edges of the ground bars and will hereinafter be called a boundary area. This results in a problem of insufficient strength of the boundary area. For example, if the objected cable is shaken with respect to the ground bars after being connected to the connector, the coaxial cables might be cut at the boundary area.

SUMMARY OF THE INVENTION

It is therefore an object of this invention to provide a cable connector which is adapted for use in connecting a cable with a pair of ground bars and which is capable of preventing a coaxial cable from being cut at an area near corners of the ground bars.

Other objects of the present invention will become clear as the description proceeds.

According to an aspect of the present invention, there is provided a connector for use in connecting a cable. The connector comprises a contact element to be connected to the cable, an insulator holding the contact element, and a conductive shell covering the insulator. The conductive shell has a holding portion for clamping and holding the cable in cooperation with the insulator.

According to another aspect of the present invention, there is provided a connector for use in connecting a cable. The connector comprises a contact element to be connected to the cable, the contact element having a contacting portion for coming in contact with a mating contact element, an insulator holding the contact element, and a conductive shell covering the insulator. The conductive shell has a holding portion for clamping and holding the cable in cooperation with the insulator. The conductive shell comprises a first shell component arranged at a position corresponding to the contacting portion. The first shell component is fixedly held by the insulator. The conductive shell further comprises a second shell component having the holding portion and removably held by the insulator. The first and the second shell components are conductive and electrically connected to each other.

According to still another aspect of the present invention, there is provided a connector for use in connecting a cable comprising a plurality of coaxial cables. Each of the coaxial cables has a cladding portion and a shield wire covered with the cladding portion. The cladding portion is nonconductive. The shield wire is conductive. The connector comprises a contact element to be connected to the cable, an insulator holding the contact element, a conductive shell covering the insulator and having a holding portion for clamping and holding the cable in cooperation with the insulator, and a pair of ground bars coupled to the insulator for holding the cable therebetween. The ground bars arrange the coaxial cables in parallel to one another. The holding portion holds the cladding portion in cooperation with the insulator. Each of the ground bars is conductive and comes in contact with the shield wires. At least one of the ground bars comes in contact with the conductive shell.

According to yet another aspect of the present invention, there is provided a connector for use in connecting a cable comprising a plurality of coaxial cables. Each of the coaxial cables has a cladding portion, a shield wire covered with the cladding portion, and a core wire which is conductive and insulated from the shield wire. The cladding portion is nonconductive. The shield wire is conductive. The connector comprises a contact element to be connected to the cable, an insulator holding the contact element, a conductive shell covering the insulator and having a holding portion for clamping and holding the cable in cooperation with the insulator, and a pair of ground bars coupled to the insulator for holding the cable therebetween. The ground bars arrange the coaxial cables in parallel to one another. The holding portion holds the cladding portion in cooperation with the insulator. Each of the ground bars is conductive and comes in contact with the shield wires. The contact element comes in contact with the core wire.

DESCRIPTION OF THE PREFERRED EMBODIMENT

Figure 1:
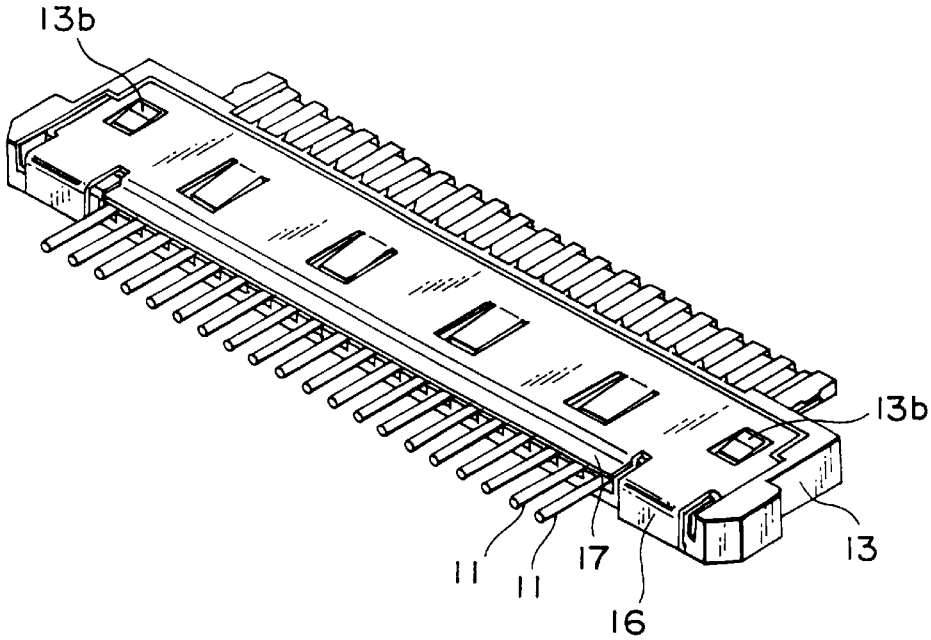
FIG. 1 is a perspective view of a connector according to an embodiment of this invention in the state where a cable is connected thereto.

Referring to FIGS. 1 through 4, description will be made of an embodiment of this invention.

A connector illustrated in the figures is to be connected to a coaxial thin wire type cable comprising a combination of a plurality of thin coaxial cables 11. The connector comprises a number of conductive contact elements 12 arranged in an array from right to left to be connected to a plurality of central conductors or core wires 11*a* in the coaxial cables 11, an insulator 13 fixedly holding the contact elements 12, and a conductive shell 14 covering the insulator 13. The contact elements 12 are fixed to the insulator 13 by press-fitting. Each of the contact elements 12 has a contacting portion 12*a* and a connecting portion 12*b*. Each of the coaxial cables 11 has a center conductor or core wire 11*a*, a cladding portion 11*b*, and a shield wire 11*c*. The contacting portion 12*a* is for coming in contact with a mating contact element known in the art. The connecting portion 12*b* is for connecting the core wire 11*a*.

The shell 14 comprises a first shell component 15 made of metal and fixedly held by the insulator 13 and a second shell component 16 made of metal and held by the insulator 13 to be slidable back and forth and therefore removable. The first shell component 15 covers a lower surface of the insulator 13 so as to correspond to the contacting portions 12*a* of the contact elements 12. The second shell component 16 is fitted into a relatively rear portion of the insulator 13 and has a holding portion 17 for clamping and holding the cladding portions 11*b* of the coaxial cables 11 in cooperation with the insulator 13. The second shell component 16 is brought into contact with an outer surface of the first shell component 15.

Figure 5:
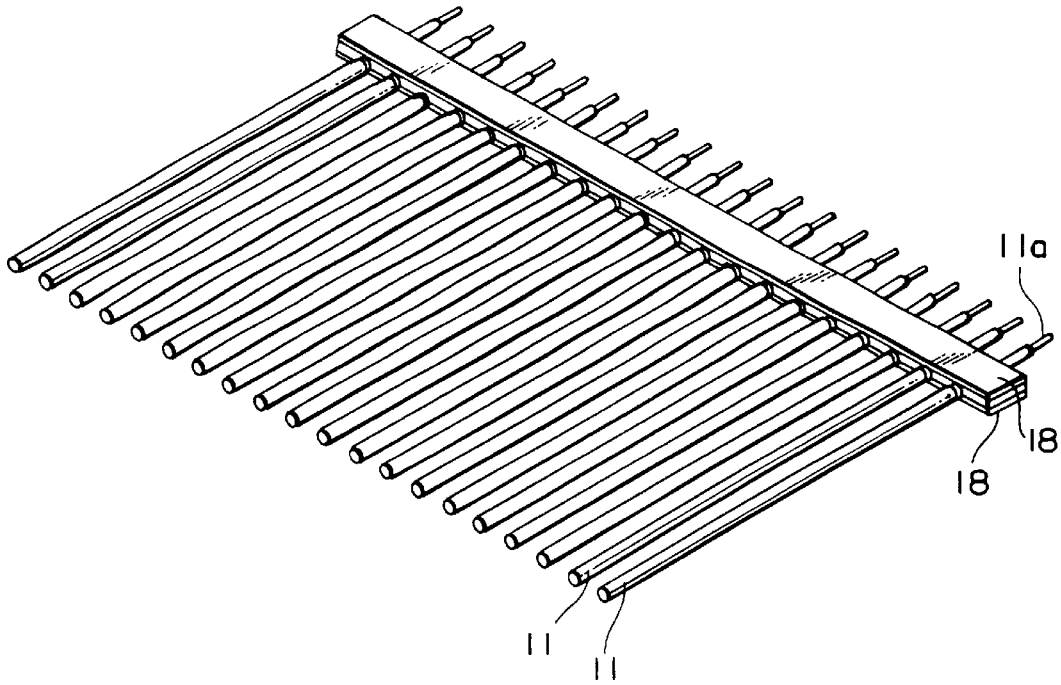
FIG. 5 is a perspective view showing a pair of ground bars with a plurality of coaxial cables attached thereto.
Figure 6:
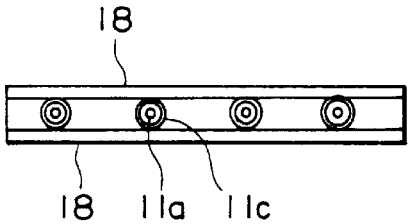
FIG. 6 is a front view of the state shown in FIG. 5.
Figure 7:
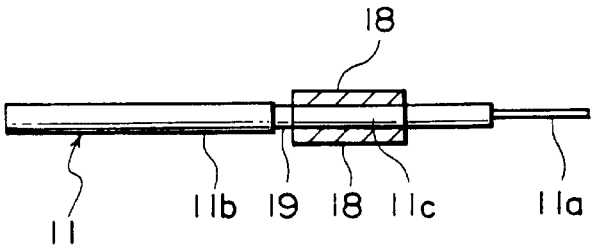
FIG. 7 is a sectional view of the state shown in FIG. 5.

Referring to FIGS. 5 through 7, description will be made as regards processing of the coaxial cables 11. The coaxial cables 11 are disposed in a flat arrangement with the shield wires 11*c* partially exposed. The exposed portions of the shield wires 11*c* are clamped by a pair of ground bars 18 made of metal and soldered thereto. Consequently, the shield wires 11*c* are electrically connected to the ground bars 18. Furthermore, the coaxial cables 11 are kept in the flat arrangement. As will readily be understood, the core wire 11*a* is exposed at the end of each coaxial cable 11.

In the coaxial cables 11 subjected to the above-mentioned processing, the coaxial cables 11 have no cladding portion 11*b* in a boundary area 19 near the corners of the ground bars 18. Therefore, the boundary area 19 may be insufficient in strength. Turning back to FIGS. 1 through 4, description will be made of an operation of connecting the coaxial cable 11 subjected to the above-mentioned processing to the connector. First, the second shell component 16 is removed from the insulator 13. The coaxial cables 11 are inserted through an opening 16*a* of the second shell component 16 together with the ground bars 18. If the insulator 13 is provided with a temporary holding portion (not shown) for temporarily holding the second shell component 16, the second shell component 16 need not be removed but is simply required to be slid.

Figure 2:
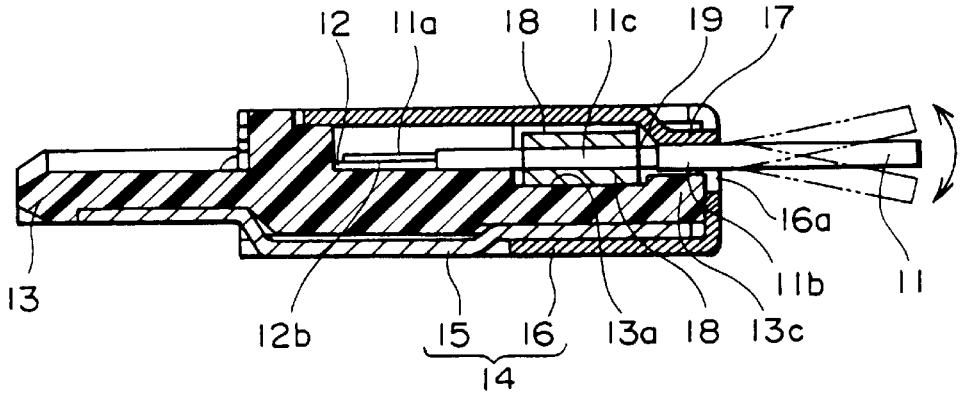
FIG. 2 is a transverse sectional view of the connector shown in FIG. 1.
Figure 3:
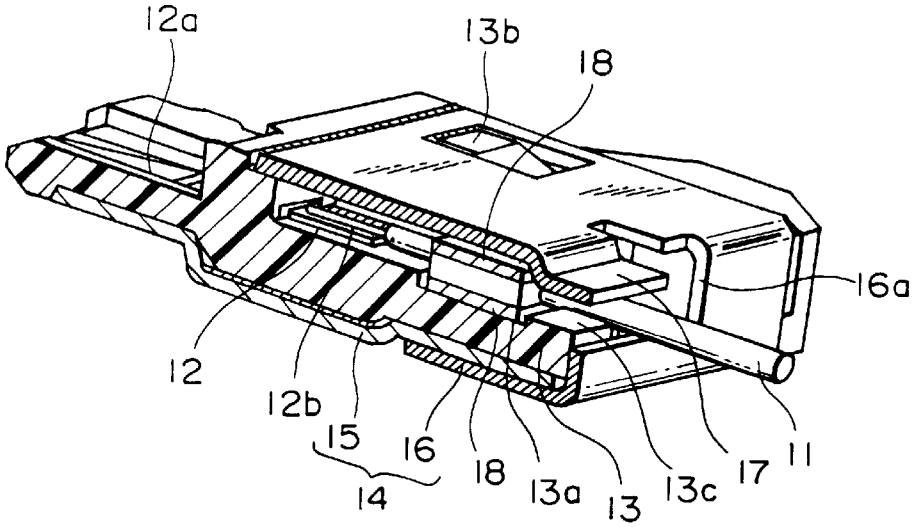
FIG. 3 is a sectional perspective view showing an internal structure of the connector of FIG. 1.
Figure 4:
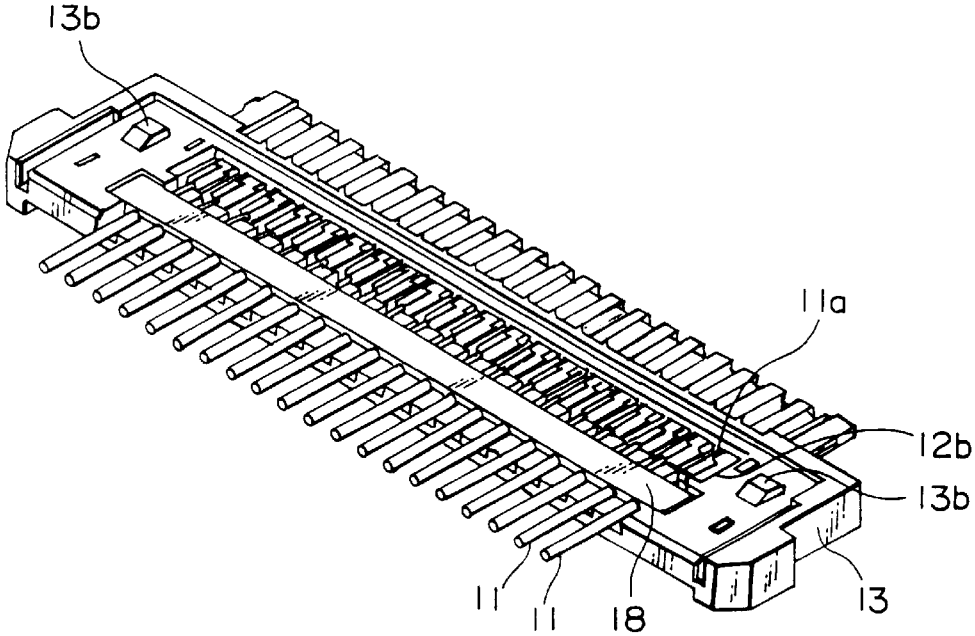
FIG. 4 is a perspective view of the connector of FIG. 1 in the state where a second shell component is removed.

Next referring to FIG. 4, the ground bars 18 are arranged in a cavity 13*a* of the insulator 13. At this time, the core wires 11*a* of the coaxial cable 11 are placed on the connecting portions 12*b* of the contact elements 12 and soldered thereto. The second shell component 16 is fitted into the insulator 13 to be brought into contact with the first shell component 15. Then, the structure shown in FIGS. 1 through 3 is obtained. The second shell component 16 is locked by a pair of engaging protrusions 13*b* formed on the insulator 13.

As a result, the ground bars 18 are held in the cavity 13*a* by the insulator 13 and the second shell component 16. The holding portion 17 of the second shell component 16 clamps and holds the cladding portions 11*b* of the coaxial cables 11 in cooperation with a corresponding portion 13*c* of the insulator 13, the corresponding portion 13*c* being opposite to the holding portion 17 via the cladding portions 11*b*. Therefore, even if the coaxial cables 11 are shaken as indicated by dot-and-dash lines in FIG. 2, the coaxial cables 11 are prevented from being cut in the boundary area 19 because the boundary area 19 is not directly subjected to external force.

As described above, according to this invention, it is possible to provide the connector adapted for use in connecting the cable with the ground bars and capable of preventing the coaxial cables from being cut in the boundary area mentioned above.

What is claimed is:

1. A connector for use in connecting a cable comprising:

a contact element to be connected to said cable;

an insulator holding said contact element;

a conductive shell covering said insulator, said conductive shell having a holding portion for holding said cable in cooperation with said insulator, said cable being clamped between said insulator and said holding portion;

said conductive shell including a first shell component fixedly held by said insulator; and a second shell component having said holding portion and removably fitted over said first shell component and said insulator to be slidable along said first shell component and said insulator.

2. The connector according to claim 1, wherein said contact element has a contacting portion for coming into contact with a mating contact element, said first shell component being arranged at a position corresponding to said contacting portion.

3. A connector for use in connecting a cable, comprising:

a contact element to be connected to said cable, said contact element having a contacting portion for coming into contact with a mating contact element;

an insulator holding said contact element; and a conductive shell covering said insulator, said conductive shell having a holding portion for holding said cable in cooperation with said insulator, said cable being clamped between said insulator and said holding portion, said conductive shell including a first shell component arranged at a position corresponding to said contacting portion, said first shell component being fixedly held by said insulator; and a second shell component having said holding portion and removably fitted over said first shell component and said insulator to be slidable along said first shell component and said insulator, said first and said second shell components being conductive and electrically connected to each other.

4. The connector according to claim 1, further comprising a pair of ground bars coupled to said insulator for holding said cable therebetween.

5. The connector according to claim 4, wherein said insulator has a cavity, at least one of said ground bars being placed in said cavity.

6. The connector according to claim 4, wherein said cable comprises a plurality of coaxial cables, said ground bars arranging said coaxial cables in parallel to one another.

7. The connector according to claim 6, wherein each of said coaxial cables has a cladding portion which is nonconductive, said holding portion holding said cladding portion in cooperation with said insulator.

8. The connector according to claim 7, wherein each of said coaxial cables has a shield wire which is conductive and covered with said cladding portion, each of said ground bars being conductive and coming in contact with said shield wires.

9. A connector for use in connecting a cable comprising a plurality of coaxial cables, each of said coaxial cables having a cladding portion and a shield wire covered with said cladding portion, said cladding portion being nonconductive, said shield wire being conductive, said connector comprising:

a contact element to be connected to said cable;

an insulator holding said contact element;

a conductive shell covering said insulator and having a holding portion for holding said cable in cooperation with said insulator, said coaxial cables being clamped between said insulator and said holding portion;

a pair of ground bars coupled to said insulator for holding said cable therebetween, said ground bars arranging said coaxial cables in parallel to one another, said holding portion holding said cladding portion in cooperation with said insulator, each of said ground bars being conductive and coming in contact with said shield wires, at least one of said ground bars coming in contact with said conductive shell, said conductive shell including a first shell component fixedly held by said insulator; and a second shell component having said holding portion and removably fitted over said first shell component and said insulator to be slidable along said first shell component and said insulator.

10. A connector for use in connecting a cable comprising a plurality of coaxial cables, each of said coaxial cables having a cladding portion, a shield wire covered with said cladding portion, and a core wire which is conductive and insulated from said shield wire, said cladding portion being nonconductive, said shield wire being conductive, said connector comprising:

a contact element to be connected to said cable;

an insulator holding said contact element;

a conductive shell covering said insulator and having a holding portion for holding said cable in cooperation with said insulator, said coaxial cables being clamped between said insulator and said holding portion;

a pair of ground bars coupled to said insulator for holding said cable therebetween, said ground bars arranging said coaxial cables in parallel to one another, said holding portion holding said cladding portion in cooperation with said insulator, each of said ground bars being conductive and coming in contact with said shield wires, said contact element coming in contact with said core wire, said conductive shell including a first shell component fixedly held by said insulator; and a second shell component having said holding portion and removably fitted over said first shell component and said insulator to be slidable along said first shell component and said insulator.

* * * * *